United States Patent [19]

Wallace

[11] 4,166,331

[45] Sep. 4, 1979

[54] STEAM FINISHING PLATEN

[75] Inventor: Marshall E. Wallace, Louisville, Ky.

[73] Assignee: W. M. Cissell Manufacturing Company, Louisville, Ky.

[21] Appl. No.: 917,420

[22] Filed: Jun. 21, 1978

[51] Int. Cl.[2] ..... D06F 71/34

[52] U.S. Cl. ..... 38/15; 223/73

[58] Field of Search ..... 38/15, 16, 66, 14; 223/70, 73; 100/73; 68/240

[56] References Cited

U.S. PATENT DOCUMENTS

| | | | |
|---|---|---|---|
| 1,597,708 | 8/1926 | Andree | 38/15 |
| 1,857,601 | 5/1932 | McDermott | 38/40 |
| 1,999,445 | 4/1935 | Davis | 38/15 |
| 2,426,747 | 9/1947 | Reece et al. | 38/15 |
| 2,555,967 | 6/1951 | Goldman | 38/15 |
| 3,512,379 | 5/1970 | Buckley et al. | 223/73 X |
| 3,797,142 | 3/1974 | Gerod | 38/15 |
| 3,968,581 | 7/1976 | Tsunoda | 38/15 |

*Primary Examiner*—Louis Rimrodt
*Attorney, Agent, or Firm*—Wood, Herron & Evans

[57] ABSTRACT

A steam finishing platen having a work surface through which steam and air can pass. The platen includes up-steam piping within a chamber defined by the platen, and a vacuum port to that chamber. A steam damper is movable between a normally open position where the vacuum port is open to a vacuum source, and a closed position where the damper closes the vacuum port when steam is provided to the up-steam piping. A steam piston, located within the platen chamber, is connected by a spring loaded linkage to the steam damper, and is connected by a steam line to the up-steam piping. When steam is provided to the up-steam piping for steaming a fabric workpiece on the platen, the steam actuated piston closes the steam damper, thereby automatically closing the vacuum port to that steam within the platen chamber.

7 Claims, 3 Drawing Figures

STEAM FINISHING PLATEN

This invention relates to finishing platens. More particularly, this invention relates to a finishing platen for use in smoothing or ironing a textile workpiece.

Finishing platens, also known as bucks, are well known for use in smoothing or ironing textile materials. In connection with such bucks or finishing platens, it is also well known to provide means for effecting transmission of a gas, e.g., air, and a vapor, e.g., steam, through the textile workpiece on the platen during the smoothing operation on that workpiece. The primary function of the steam is to aid in pressing the workpiece and the primary function of the air is to aid in drying the workpiece after it has been steamed. To implement this method concept, it is known to cover a platen with a perforated head plate that allows steam introduced into the platen chamber, or air introduced into the platen chamber, to pass upwardly out of the chamber through the workpiece on the perforated head plate, and that allows vacuum introduced into the platen chamber to draw atmospheric air into the chamber through the workpiece.

One particular type of finishing buck or platen with which this basic structural concept is well known is known in the trade as a steam finishing board. A steam finishing board basically comprises a horizontally disposed ironing board or buck that defines a hollow chamber, and that is provided with a fabric covered perforated head plate. A finishing iron of the manual type is used to put the finishing touches on garments or other textile workpieces placed on top the finishing board. The finishing board's chamber, as is well known, is provided with perforated upsteam piping which, when supplied with low pressure steam, allows that steam to escape up through the fabric covered perforated head plate and, therefore, through the fabric workpiece on the finishing board, since the low pressure steam within the platen is at a higher pressure than atmospheric pressure. The purpose of the steaming step is, as earlier mentioned, for aiding or enhancing the smoothing or ironing operation on the fabric workpiece. Further, it is known to connect the steam finishing board'chamber with a vacuum source. When the supply steam to the platen chamber is cut off, vacuum may be introduced into the chamber to draw atmospheric air through the fabric workpiece on the finishing board for aiding in drying the workpiece after it has been steamed and ironed, also as earlier mentioned. This structural combination, in the steam finishing board environment, is very effective in, particularly, industrial or commercial type laundry and dry cleaning operations, to touch up or finish smoothing or ironing fabric workpieces, e.g., garments, either too small to finish on other type equipment, or which require additional attention after being primarily finished on other smoothing or ironing equipment.

There is, however, one problem of significance in connection with finishing platens, e.g., steam finishing boards, known to the prior art of the type described above. This problem occurs because the steam chamber and the vacuum chamber defined by the finishing platen constitutes one and the same chamber. In this connection, it is commonplace to have steam condensate from the steaming operation run or flow back through the vacuum piping. Oftentimes this steam condensate escapes from the vacuum piping at pipe joints, and since the vacuum piping is commonly connected with the board or platen through the board's stand or framework, the condensate flows in water puddles on the floor around the finishing board's work station. Such water puddles are, of course, undesirable from an operator's standpoint as it is neither healthful nor desirable to stand in a puddle of water while using the steam finishing board.

Accordingly, it has been the primary object of this invention to provide an improved steam finishing platen of the type that permits steaming of a fabric workpiece, as well as air flow through that fabric workpiece, that includes, in combination, a steam damper operatively connected with a steam piston for closing the air line to the platen chamber when the platen is in the steaming attitude, and operatively connected with spring loaded linkage for opening the platen chamber to the air line when the platen is not in the steaming attitude, that steam piston being so connected with the platen's up-steam piping that the piston is actuated automatically when the up-stream piping is opened to a steam supply source.

It has been another objective of this invention to provide an improved steam finishing platen of the type having a fabric covered perforated head plate substantially horizontally disposed to floor level, that board including perforated up-stream piping in a platen chamber defined by that finishing platen, and a vacuum port defined by that platen chamber, in novel combination with a steam damper normally spring biased to an open position for opening the chamber to a vacuum source through the vacuum port when desired by an operator, and which is operatively connected through a steam piston positioned in the chamber to the up-steam piping for automatically closing the vacuum port when steam is supplied to the up-stream piping, all as controlled by the operator of the steam finishing platen.

In accord with these objectives, the improved steam finishing platen of this invention, in its preferred steam finishing board form, includes a work surface through which steam and air can pass. The board includes up-stream piping within a chamber defined by the board, and a vacuum port to that chamber. A steam damper is movable between a normally open position where the vacuum port is open to a vacuum source, and a closed position where the damper closes the vacuum port when steam is provided to the up-stream piping. A steam piston, located within the board chamber, is connected by a spring loaded linkage to the steam damper, and is connected by a steam line to the up-stream piping. When steam is provided to the up-stream piping for steaming a fabric workpiece on the board, the steam actuated piston closes the steam damper, thereby automatically closing the vacuum port to that steam within the board chamber.

Other objectives and advantages of this invention will be more apparent from the following detailed description taken in conjunction with the drawings in which.

Figure 1:
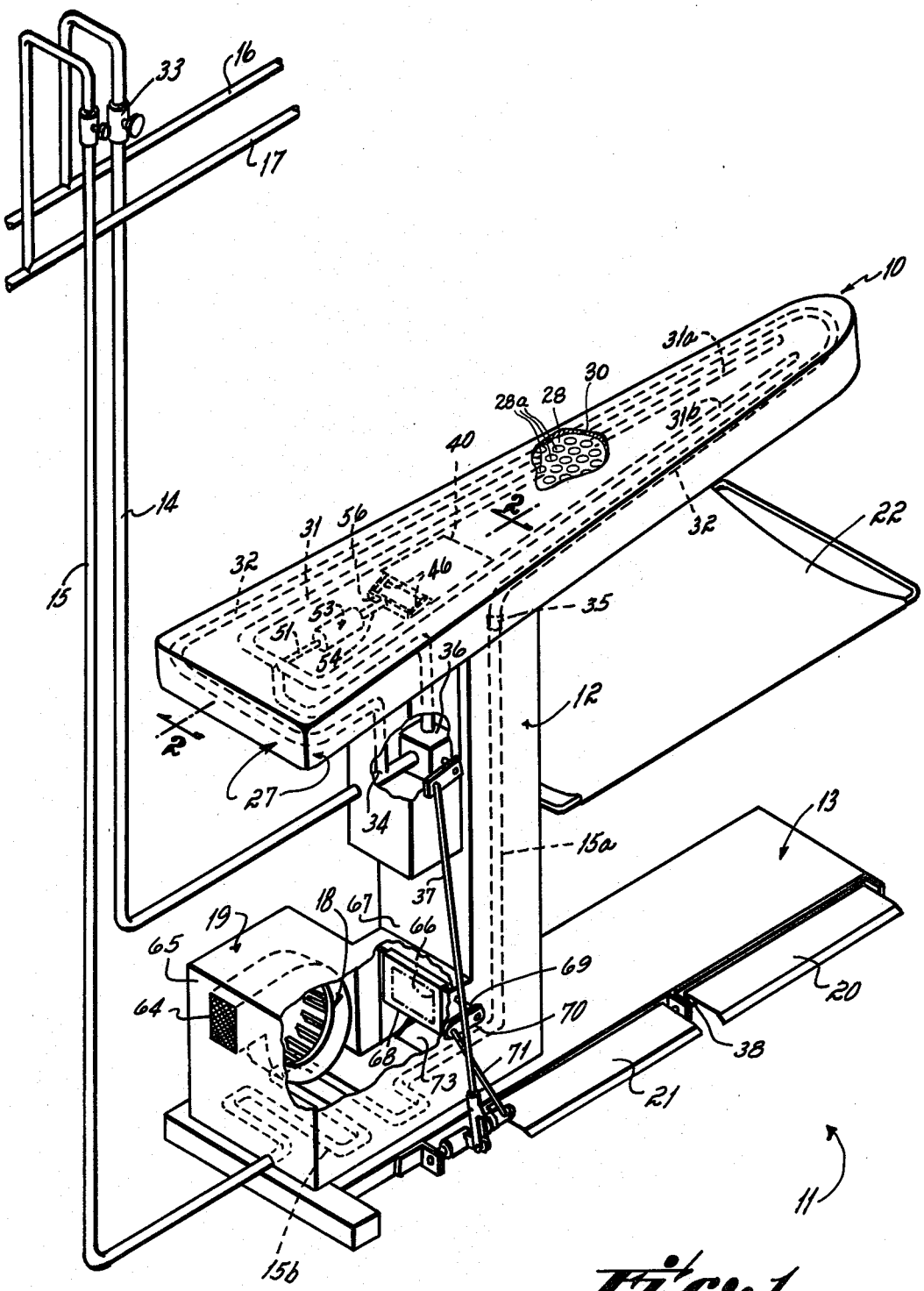
FIG. 1 is a partially broken away perspective view illustrating, in steam finishing board structural form, an improved steam finishing platen in accord with the principles of this invention.

A steam finishing platen 10 in accord with the principles of this invention is shown in the environment of a steam finishing board 11. As shown in FIG. 1, the steam finishing board 11 includes a generally horizontal platen or buck 10 disposed above ground level, and supported in that generally horizontal and level position by a post 12 and base 13 frame structure. The buck 10 is connected by piping 14, 15 with steam supply source 16 and steam return 17 lines, respectively, and is provided with a vacuum source 18 in vacuum pump housing 19 on the base 13. The steaming and vacuum operations of the steam finishing board 11 are controlled by steam foot pedal 20 and vacuum foot pedal 21 pivotally mounted on the base 13. A garment tray 22 is connected to the support post 12.

Figure 2:
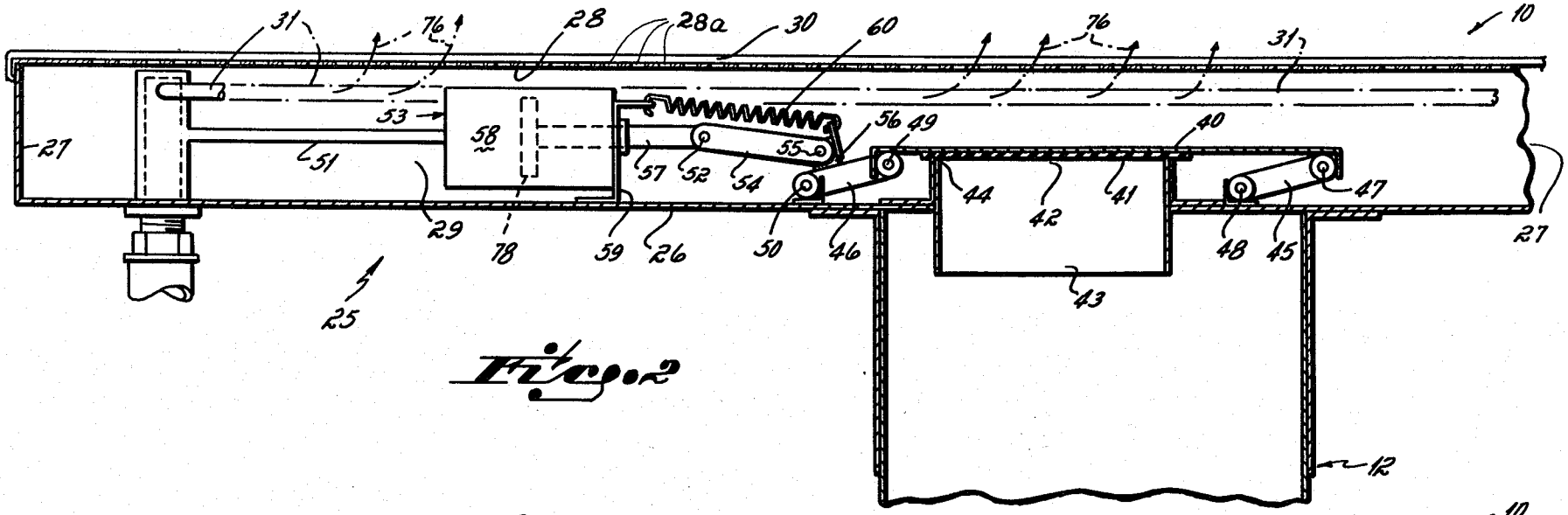
FIG. 2 is a cross sectional view taken along line 2—2 of FIG. 1, the steam damper being illustrated in the closed or up-stream attitude.
Figure 3:
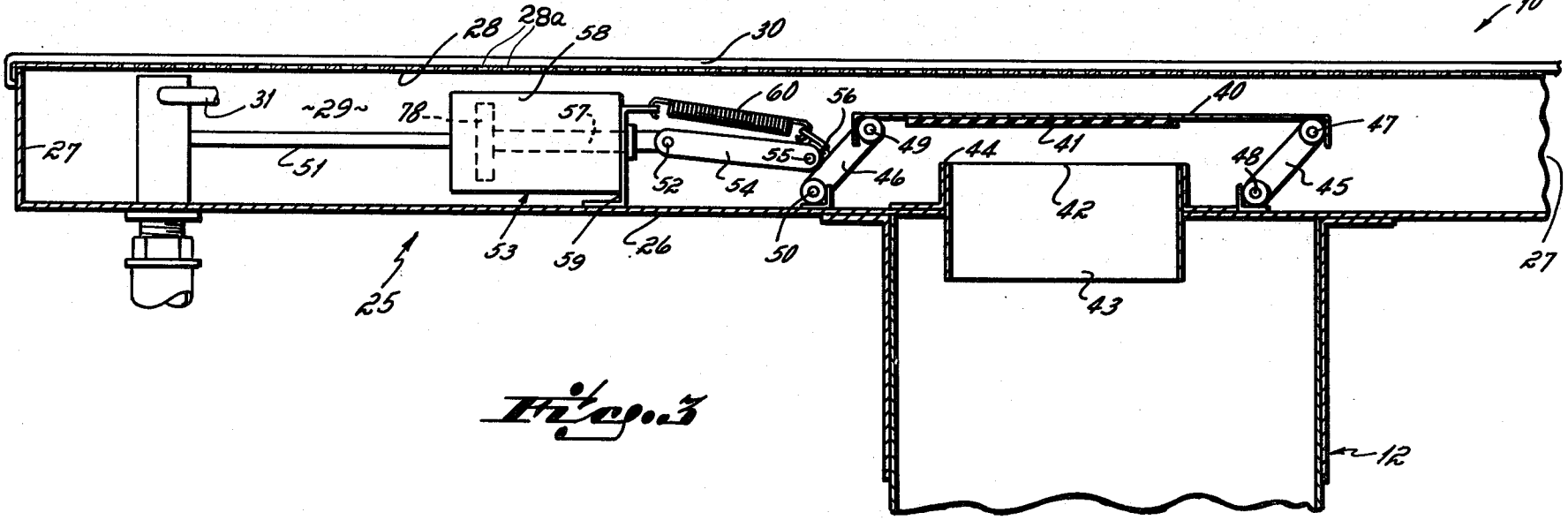
FIG. 3 is a cross sectional view similar to FIG. 2, but showing the steam damper in the open or vacuum attitude.

The buck or platen 10 of the steam finishing board 11 is illustrated in structural detail in FIGS. 1–3. The platen 10 bascially includes a hollow housing member 25 having floor 26 and upstanding peripheral sidewall 27. The hollow housing 25 is covered by a perforated head plate 28 provided with a multiplicity of holes **28*a* through which steam and air can pass, thereby defining platen chamber 29. The perforated head plate 28 is covered with a fabric cover 30** during use so as to establish a relatively smooth surface on which the ironing or smoothing of fabric workpieces may be accomplished by a hand iron, not shown.

The interior or platen chamber 29 of the buck 10 is provided with up-steam piping 31 and a heater piping loop 32. The heater piping loop 32 is closed, i.e., has no exhaust ports therein, and is connected with steam supply line 16 by take-off line 14. Valve 33 is provided in the steam take-off line 14 to provide on/off control for steam to the finishing board 11. The valve 33 is normally open when the board 11 is being used so as to maintain the board at an elevated temperature due to continuous steam circulation through the heater piping 32. The steam heater piping 32 is configured to extend around the interior periphery of the platen 10, and is connected with steam take-off line 14 as at 34. The heater piping 32 connected with return line 15 as at 35, the return line 15 including a section **15*a* that extends down through the board's support column 12, and a serpentine section 15*b* that extends through the vacuum housing 19 for a purpose to be explained below. The up-steam piping 31, which includes up-stream arms 31*a* and 31*b*, is taken off the steam take-off line 14 downstream of the heater piping loop's take-off location 34. The up-stream piping 31 within the buck's chamber 29 is provided with a multiplicity of pinholes (not shown) for providing positive steam pressure in that chamber when desired by the board's operator. The up-stream piping 31 is controlled by foot valve 36 connected by steam tie rod 37 to a shaft 38 operable by steam pedal 20 in the known fashion, all as shown in FIG. 1. The up-stream piping 31 is not connected with steam return line 17 since steam introduced into the up-stream arms 31*a*, 31*b* by foot controlled valve 36 exhausts into the platen's chamber 39 through that piping's pinholes (not shown) when it is desired to pass stream through the fabric 30 covered perforated head plate 28 of the platen 10** to aid in smoothing or ironing a fabric workpiece (not shown) thereon.

A steam damper 40 is also connected with the up-stream piping 31. The steam damper 40 is of a generally planar configuration provided with a relatively flexible, e.g., rubber, seal 41 on the under side thereof. The steam damper 40, as shown in FIGS. 2 and 3, is adapted to open and close an air port 42 defined in the floor 26 of the buck 10. The air port 42 is defined by chimney type sleeve 43 fixed to the buck's floor 26, and having a top edge 44 extending above the inside surface of that floor, thereby permitting the steam damper 40 to effect a seal around the periphery of that port.

The steam damper 40 itself is connected with the platen's floor 26 by two pair 45, 46 of opposed parallel links at the leading and trailing edges thereof. In other words, the leading edge of the damper has spaced parallel links 45 connected therewith on common pivot axis 47, the other ends of those links being connected on common pivot axis 48 to board's floor 26. Further, the tailing edge of the damper has spaced parallel links 46 connected on common pivot axis 49 to the trailing edge of the damper, and connected on common pivot axis 50 to the board's floor 26. The leading parallel links 45 and the trailing parallel links 46 are all of equal length, thereby permitting the platen to open and close while retaining a generally horizontal position relative to the platen's floor 26 and, thereby, to ground, compare FIGS. 2 and 3.

A steam piston 53 is connected to the rear pair of parallel links 46 through a drive link 54 pivotally connected at one end on axis 55 to a cross bar 56 which connects those rear links, and pivotally connected at the other end on axis 52 to the piston rod 57. The steam piston's cylinder 58 is mounted on bracket 59 and fixed in place to the inside surface of the buck's floor 26. Tension spring 60 connects to the rear parallel link pair 46 at one end and the bracket 59 at the other end, thereby normally spring biasing the parallel linkage 45, 46 and steam damper 40 into the port 42 open attitude illustrated in FIG. 3. In other words, and with the steam piston 53 not exposed to steam pressure as shown in FIG. 3, the tension spring 60 continuously biases the steam damper 40 open as shown in FIG. 3.

The steam cylinder 58 is connected by feed line 51 to the up-stream piping 31. Since the up-stream piping 31 is controlled by foot valve 36 in the feed line 14, the steam feed to the steam cylinder 58 is also controlled by that same steam valve. In this way, therefore, when foot valve 36 is operated by steam pedal 20, and immediately upon live steam being introduced into the upsteam piping 31, that live steam also activates the steam piston 53 for closing the steam damper 40 into the closed attitude illustrated in FIG. 2. This, of course, closes the steam damper against the tension bias of spring 60, and insures that the vacuum port 42 is closed as steam is exhausted into the buck's chamber 29 and through the fabric workpiece (not shown) on the buck's fabric covered head plate 28.

The buck 10 itself is supported on the floor frame 13 of the steam finishing board 11 by post or column 12. This column 12 is hollow and is, in effect, a vacuum column that connects with the vacuum housing 19. The vacuum housing 19 is simply a hollow box having a vacuum pump 18 of the squirrel cage fan type mounted therein. The vacuum housing 19 defines exhaust port 64 for the vacuum pump 18 in the end wall 65 of that housing. The vacuum housing 19 is connectable with the vacuum column 12 through damper port 66 (shown in phantom lines) defined in the housing's wall (not shown) adjacent sidewall 67 of that vacuum column. The damper port 66 is controlled, i.e., opened and closed, by a damper plate 68 mounted on horizontal pivot rod 69, that plate being connectable by ear 70 and vacuum tie rod 70 to vacuum pedal 21 of the steam finishing board 11. When the vacuum pedal 21 is depressed, the vacuum damper 68 is opened, thereby exposing the vacuum column 12 to vacuum and, if the steam damper 40 is open, the buck's chamber 29 to vacuum as well. In this attitude, atmospheric air is drawn through the board's perforated head plate 28 to aid in drying any fabric workpiece thereon that had been earlier steamed, the air thereafter being exhausted through exhaust port 64 of the vacuum housing 19. Of course, when the vacuum damper 68 is closed, as shown in FIG. 1, neither the vacuum column 12 nor the buck's chamber 29 is exposed to vacuum even if the steam damper 40 is open as shown in FIG. 3.

Note that the steam return line section **15*b* from the heater piping loop 32 extends horizontally in serpentine fashion across the floor of the vacuum housing 19. Any steam condensate that does manage to exhaust through vacuum port 42 in the board's floor is directed by angle plate 73 at the bottom of the vacuum column 12 onto the floor of the vacuum housing 19. Because the vacuum housing 19 interior is relatively hot, and particularly if the condensate touches serpentine steam return pipe section 15*b* on that floor, same flashes off and is exhausted to atmosphere through the vacuum exhaust port 64 by the vacuum pump 18**.

In use of the steam finishing board 11, and when it is desired to provide positive steam pressure within the buck's chamber 29, i.e., to expose the fabric workpiece (not shown) on the board to steam through the perforated fabric covered head plate 28 of that buck, an operator simply depresses steam pedal 20 as shown in FIG. 1. When the steam pedal 20 is depressed, steam tie rod 37 is activated (it is connected with that steam pedal through shaft 38 and associated structure not shown in detail) to open the up-steam control valve 36. When the steam control valve 36 is open, live steam is directed into the perforated up-stream piping 31, thereby permitting steam to pass upwardly as shown by phantom arrows 76 through the fabric covered perforated heat plate 28 and any fabric workpiece (not shown) thereon. Furthermore, and quite importantly, as soon as the steam control valve 36 is opened, the live steam also is fed to the steam cylinder 58 through steam line 51, thereby actuating the piston 78 to close the steam damper 40. Movement of the steam piston 78 causes the parallel linkage 45, 46 to pivot clockwise as shown in FIG. 2, thereby closing the steam damper 40 and sealing off the vacuum port 42. This closure of the steam damper 40 is against the tension bias of the tension spring 60. In this regard, it is quite important to note that the steam piston 53 need not be fabricated with close tolerances, i.e., need not be leak proof to the steam. This for the reason that, of course, the steam piston 53 is located within the interior chamber 29 defined by the buck 10. Hence, any leakage of steam from the steam piston 53 simply leaks into the chamber 29 of the buck 10 and, since the buck is in the up-steam attitude at the time the steam piston is actuated, this leakage steam simply adds to the positive steam pressure in the chamber.

When it is desired to pass air through the buck's head plate 28, i.e., to expose the chamber 29 to vacuum, the board's operator simply releases the steam floor pedal 20 and depresses the vacuum foot pedal 21. When the steam floor pedal 20 is released, control valve 36 closes, thereby cutting off live steam pressure to the up-stream piping 31 and to the steam piston 53. Because the steam piston 53 is no longer exposed to steam pressure, the tension spring 60 force returns the parallel linkage 45, 46 and the piston 78 to that attitude shown in FIG. 3 at which, of course, the vacuum port 42 is opened. When the vacuum port 42 is opened, and it is so opened automatically by tension spring 60 upon release of the steam pedal 20 by the board's operator, the vacuum pedal 21 may be depressed for exposing the buck's chamber 29 to vacuum from the constantly running vacuum pump 18. The operation of vacuum pedal 21 by the board's operator causes vacuum damper 68 to open the vacuum port 66 between the vacuum pump housing 19 and the vacuum column 12. Hence, atmospheric air drawn into the buck's chamber 29 and down through the vacuum column 12 is exhausted by the vacuum pump 18 through the vacuum exhaust port 64 in the vacuum housing 19. Any steam condensate that manages to pass the vacuum port 42 in the buck's floor 26 is directed onto the floor of the vacuum housing 19 by angle diverted plate 73 at the bottom of the vacuum column 12. And any condensate on the vacuum housing's floor is rapidly evaporated because of the relatively high temperature of the vacuum housing's interior due to the serpentine section **15*b* of the steam return line 15**.

Having described in detail the preferred embodiment of my invention, what I desire to claim and protect by Letters Patent is:

1. A steam finishing platen for use in smoothing a textile workpiece comprising a housing defining an interior chamber, said housing including a perforated head plate through which steam and air may be passed, an air port in said housing, a steam damper adapted to open and close said air port, up-steam piping disposed within said interior chamber, said up-steam piping being connectable with a steam supply source, a steam piston connected with said steam damper, and connected with said up-stream piping, and a control valve in a steam supply line connected with said up-stream piping and said steam piston, said steam piston being automatically operable to close said steam damper in response to steam being provided in said up-steam piping through use of said control valve.

2. A steam finishing platen as set forth in claim 1, said steam piston being located within said interior chamber, any steam leakage from said steam piston thereby being exhausted into said interior chamber only when said up-stream piping is exposed to a steam supply source through said control valve.

3. A steam finishing platen as set forth in claim 1, said platen further comprising a spring connected with said steam damper, said spring continuously biasing said steam damper to the open attitude, activation of said steam piston overcoming said spring bias to close said steam damper.

4. A steam finishing platen as set forth in claim 3, including parallel linkage structure connecting said steam damper and said floor, said parallel linkage structure permitting said steam damper to open and close while maintaining parallel relation of said damper with said floor.

5. A steam finishing platen as set forth in claim 4, said air port comprising a chimney connected to said housing floor, said chimney defining an air port located within said interior chamber above said housing floor.

6. A steam finishing platen as set forth in claim 1, said platen further comprising a vacuum housing connectable with said air port, and a vacuum pump located within said vacuum housing, said vacuum pump being operable to draw air through said air port from said interior chamber and exhaust said air to atmosphere.

7. A steam finishing platen as set forth in claim 6, said platen further comprising a vacuum damper provided in a vacuum line connecting said vacuum pump and said air port, said vacuum damper being operable by a foot pedal to expose said interior chamber to a vacuum.

* * * * *

UNITED STATES PATENT AND TRADEMARK OFFICE

CERTIFICATE OF CORRECTION

PATENT NO. : 4,166,331

DATED : September 4, 1979

INVENTOR(S) : Marshall E. Wallace

It is certified that error appears in the above-identified patent and that said Letters Patent are hereby corrected as shown below:

Col. 1, line 35 "upsteam" should be -- up-steam --

Col. 1, line 45 "board' " should be -- board's --

Col. 2, line 28 "up-stream" should be -- up-steam --

Col. 2, line 37 "up-stream" should be -- up-steam --

Col. 2, line 43 "up-stream" should be -- up-steam --

Col. 2, line 52 "up-stream" should be -- up-steam --

Col. 2, line 53 "up-stream" should be -- up-steam --

Col. 2, line 68 "up-stream" should be -- up-steam --

Col. 3, line 49 "up-stream" should be -- up-steam --

Col. 3, line 52 "up-stream" should be -- up-steam --

Col. 3, line 55 "up-stream" should be -- up-steam --

Col. 3, line 59 "up-stream" should be -- up-steam --

Col. 3, line 60 "up-stream" should be -- up-steam --

Col. 3, line 63 "stream" should be -- steam --

Col. 3, line 68 "up-stream" should be -- up-steam --

Col. 4, line 17 "tailing" should be -- trailing --

UNITED STATES PATENT AND TRADEMARK OFFICE

CERTIFICATE OF CORRECTION

PATENT NO. : 4,166,331

DATED : September 4, 1979

INVENTOR(S) : Marshall E. Wallace

It is certified that error appears in the above-identified patent and that said Letters Patent are hereby corrected as shown below:

Col. 4, line 42 "up-stream" both occurances should be -- up-steam--

Col. 4, line 47 "upsteam" should be -- up-steam --

Col. 5, line 3 "rod 70" should be -- rod 71 --

Col. 5, line 40 "up-stream" should be -- up-steam --

Col. 6, line 1 "up-stream" should be -- up-steam --

Col. 6, line 42 "up-stream" should be -- up-steam --

Col. 6, line 44 "up-stream" should be -- up-steam --

Col. 6, line 53 "up-stream" should be -- up-steam --

Signed and Sealed this

*Fifth* Day of *February 1980*

[SEAL]

*Attest:*

SIDNEY A. DIAMOND

*Attesting Officer*

*Commissioner of Patents and Trademarks*